US009995114B2

(12) United States Patent
Stowe, II

(10) Patent No.: US 9,995,114 B2
(45) Date of Patent: Jun. 12, 2018

(54) HIGH EFFICIENCY NOZZLE

(71) Applicant: Calvin J. Stowe, II, Bellaire, TX (US)

(72) Inventor: Calvin J. Stowe, II, Bellaire, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 579 days.

(21) Appl. No.: 14/455,311

(22) Filed: Aug. 8, 2014

(65) Prior Publication Data

US 2016/0040505 A1 Feb. 11, 2016

(51) Int. Cl.

| | |
|---|---|
| ***E21B 37/00*** | (2006.01) |
| ***E21B 41/00*** | (2006.01) |
| ***B05B 1/34*** | (2006.01) |
| *B05B 13/06* | (2006.01) |

(52) U.S. Cl.

CPC ..... *E21B 37/00* (2013.01); *B05B 1/34* (2013.01); *E21B 41/0078* (2013.01); *B05B 13/0627* (2013.01)

(58) Field of Classification Search

CPC ..... E21B 33/16
USPC ..... 239/589, 601, 602
See application file for complete search history.

(56) References Cited

U.S. PATENT DOCUMENTS

| | | | | |
|---|---|---|---|---|
| 4,441,557 A * | 4/1984 | Zublin | E21B 41/0078 134/167 C |
| 5,931,392 A * | 8/1999 | Adams | B05B 1/042 239/589 |
| 6,289,987 B1 * | 9/2001 | Lay, Jr. | E21B 21/00 166/169 |
| 2014/0319246 A1 * | 10/2014 | Lehmann | B05B 1/34 239/437 |

* cited by examiner

*Primary Examiner* — Robert E Fuller
*Assistant Examiner* — Steven A MacDonald
(74) *Attorney, Agent, or Firm* — Cantor Colburn LLP

(57) ABSTRACT

A system, method and apparatus for cleaning a wellbore is disclosed. A workstring is conveyed in a wellbore. A jet sub provided associated with the wellbore, wherein the jet sub includes at least one nozzle, the nozzle including: an inlet; an outlet; at least four successive concentric stages in fluid communication with the inlet and the outlet, wherein each of the at least four stages has a discrete length, and the stages have progressive smaller discrete diameters, and an interface formed between each stage. A completion fluid is provided to the at least one nozzles via the work string and jet sub. The completion fluid is expelled via the at least one nozzles.

18 Claims, 4 Drawing Sheets

HIGH EFFICIENCY NOZZLE

BACKGROUND

1. Field of the Disclosure

The present invention is related to a high efficiency nozzle and, in particular, a high efficiency nozzle to clean equipment in a wellbore.

2. Background of the Art

Various downhole operations, such as milling, etc., create debris and particles that circulate and settle within the wellbore. In certain applications, such debris and particles negatively affect wellbore equipment such as blow out preventers and other equipment. In such applications, cleaning operations are performed to remove debris from wellbore equipment and generally clean wellbore walls. However, most current wellbore cleaning apparatuses, including traditional nozzles, induce turbulence, that causes the stream to disperse and lose energy rapidly. Accordingly, current wellbore cleaning apparatuses may not provide sufficient velocity and force to remove debris and particles, diminishing cleaning effectiveness, leading to slow or incomplete cleaning operations.

SUMMARY OF THE DISCLOSURE

In one aspect, the present disclosure provides a nozzle including an inlet; an outlet; at least four successive concentric stages in fluid communication with the inlet and the outlet, where the at least four stages each have a discrete length and a successively smaller discrete diameter; and a plurality of interfaces formed between each of the stages.

In another aspect, the present disclosure provides a system to clean a wellbore, including a work string; and a jet sub containing at least one nozzle, wherein the at least one nozzle includes: an inlet; an outlet; at least four successive concentric stages in fluid communication with the inlet and the outlet, where the at least four stages each have a discrete length and a successively smaller discrete diameter; and a plurality of interfaces formed between each of the stages.

Examples of certain features of the apparatus and method disclosed herein are summarized rather broadly in order that the detailed description thereof that follows may be better understood. There are, of course, additional features of the apparatus and method disclosed that will form the subject of the appended claims.

BRIEF DESCRIPTION OF THE DRAWINGS

This disclosure is best understood by the accompanying figures.

DETAILED DESCRIPTION OF THE EMBODIMENTS

Figure 1:
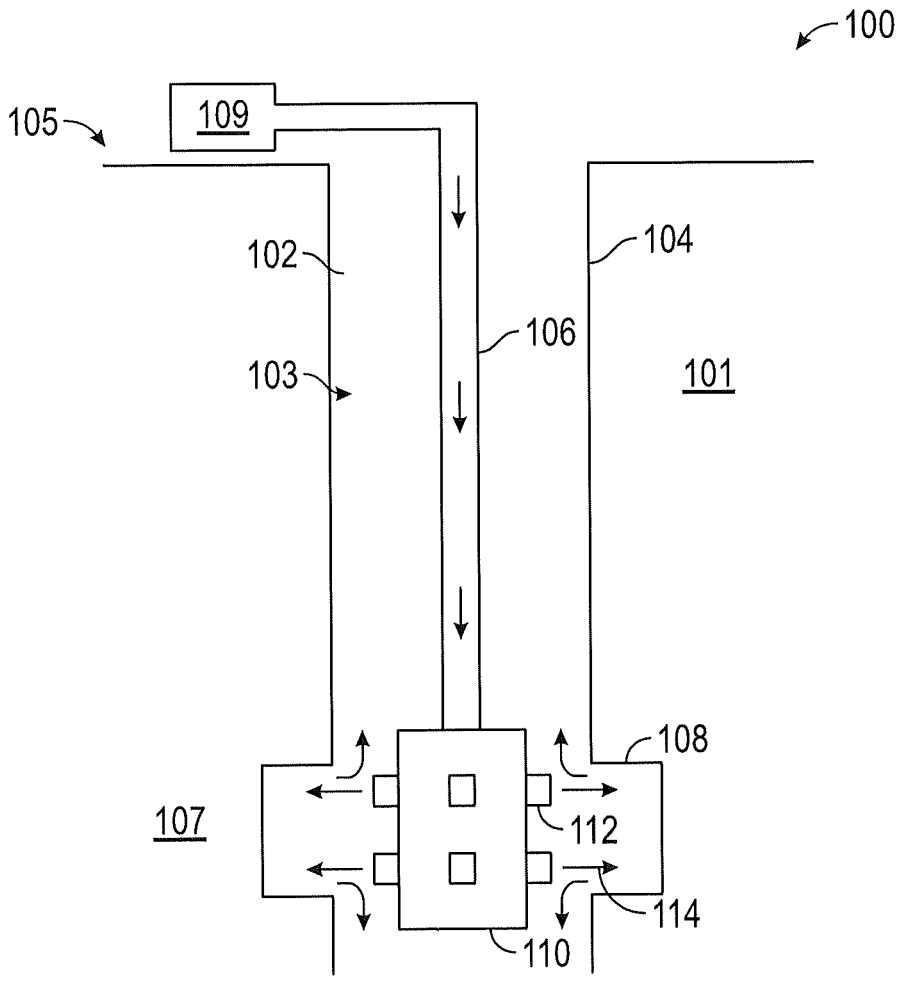
FIG. 1 shows a downhole system that includes a wellbore cleaning system for removing debris and particles.

FIG. 1 shows a downhole system 100 that includes a wellbore cleaning system 103 for cleaning wellbore 102 in an exemplary embodiment of the disclosure. The wellbore cleaning system 103 includes a work string 106 disposed in a wellbore 102 formed in a formation 101. The work string 106 extends in the wellbore 102 from a surface location 105 to a downhole location 107. A cleaning tool 110 is conveyed by the work string 106. The tool 110 is coupled to a flow control device 109 via work string 106. Flow control device 109 controls the flow 114 through work string 106 and tool 110 to control the cleaning output of tool 110. In various embodiments, the flow control device 109 may be at a surface location 105 or at a suitable location in the work string 106.

In an exemplary embodiment, the wellbore cleaning tool or jet sub 110 is conveyed to a selected depth of the wellbore 102 by the workstring 106. In certain embodiments, the wellbore cleaning tool 110 is conveyed to be adjacent to wellbore equipment 108 to be cleaned. Wellbore equipment 108 includes any equipment placed downhole, such as, blow out preventers. Particularly, after milling of casing 104 or other operations, particles and debris circulate within the wellbore 102, requiring removal of such particles and debris to ensure proper operation of wellbore equipment 108. The tool 110 includes one or more nozzles 112 to facilitate flow of a cleaning fluid flow 114 within the wellbore 102 and particularly within equipment 108. Multiple nozzles 112 may be included to facilitate flow of cleaning fluid flow 114. Flow from nozzles 112 may flow outward into equipment 108 and afterwards move upward or downward within wellbore 102 removing particles and debris. Tool 110 may be translated within the wellbore 102 and rotated to ensure cleaning of the wellbore 102 and wellbore equipment 108. Fluid flow 114 may include completion fluid such as salt water with polymer particulate, mud, or produced fluids. Details of the tool 110 and nozzle 112 are discussed below with respect to FIGS. 2 and 3.

Figure 2A:
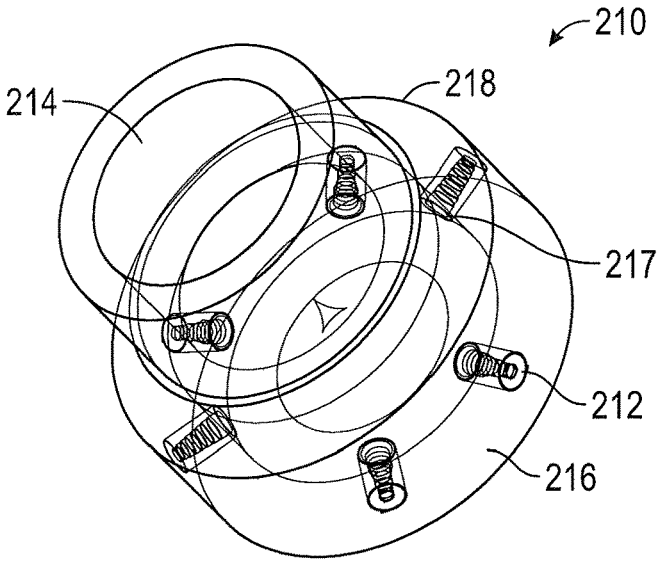
FIG. 2A shows an isometric view of the cleaning tool of the wellbore cleaning system of FIG. 1 for use in removing debris and particles.
Figure 2B:
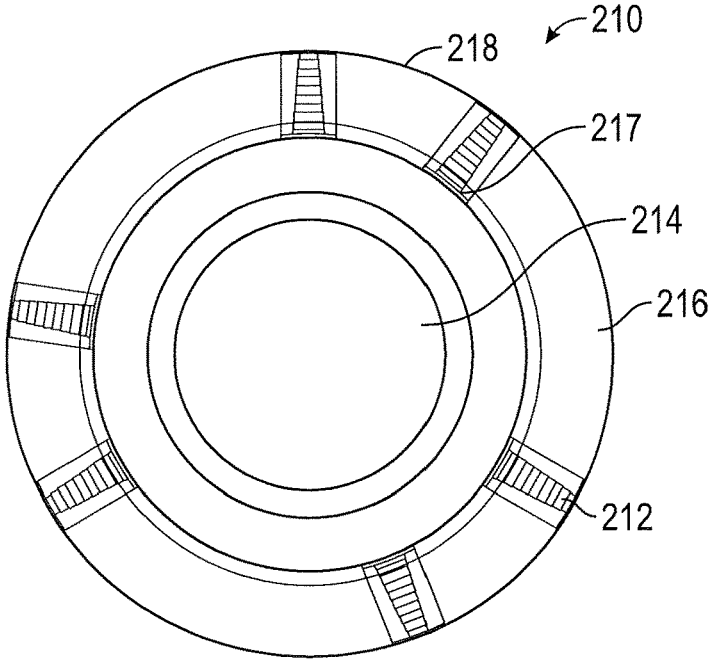
FIG. 2B shows a bottom elevation view of the cleaning tool of the wellbore cleaning system of FIG. 1 for use in removing debris and particles.

FIGS. 2A and 2B show an exemplary cleaning tool 210, (also referred to as a jet sub) suitable for cleaning wellbore 102 and wellbore equipment 108. The cleaning tool 210 includes nozzles 212, bore 214, mounting ring 216, and body 218. Body 218 may be formed of any suitable material, particularly a material suitable to withstand the environment of wellbore 102. In an exemplary embodiment, the body 218 has a generally cylindrical shape with a bore 214 formed therethrough. Bore 214 allows for flow 114 of a cleaning fluid or completion fluid to flow from a work string 106 out into the wellbore 102 via nozzles 212. Nozzles 212 are mounted to mounting ring 216, via any suitable means, such as threaded or other mechanical fastening means. Flow 114 is received by nozzles 212 from bore 214 via openings 217 in mounting ring 216. The inlets of nozzles 212 are in fluid communication with openings 217 to receive flow 114 from bore 214.

Figure 3A:
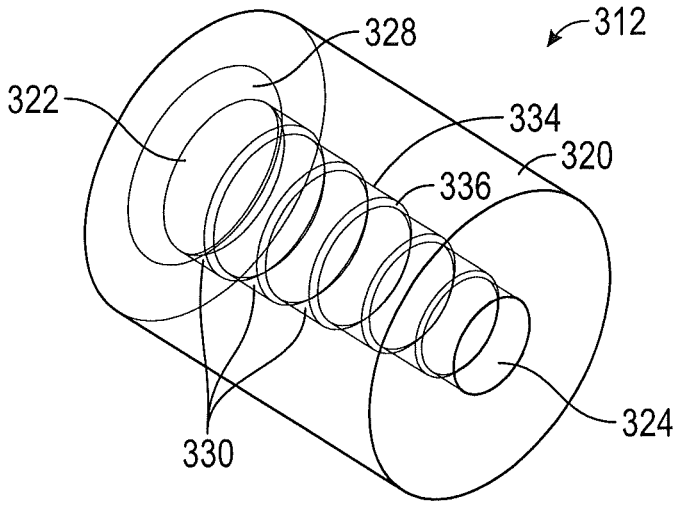
FIG. 3A shows an isometric view of the nozzle of the cleaning tool of FIG. 2A for use in removing debris and particles.
Figure 3B:
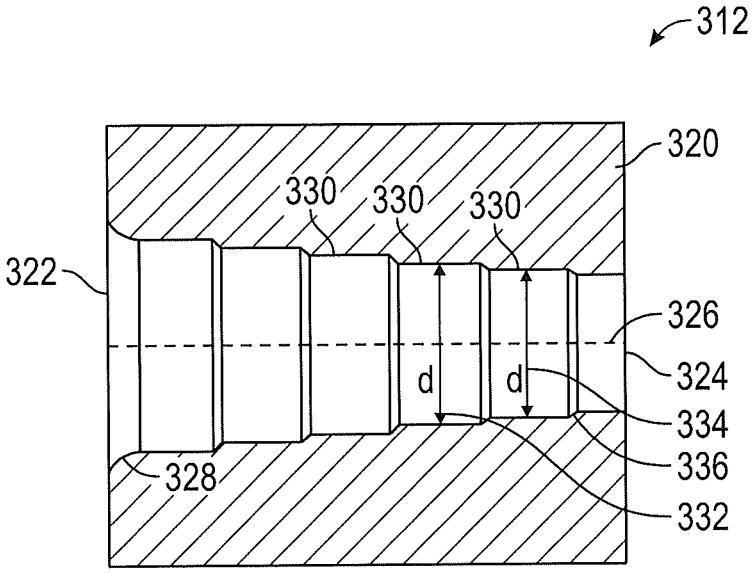
FIG. 3B shows a side elevation view of the nozzle of the cleaning tool of FIG. 2A for use in removing debris and particles.
Figure 3C:
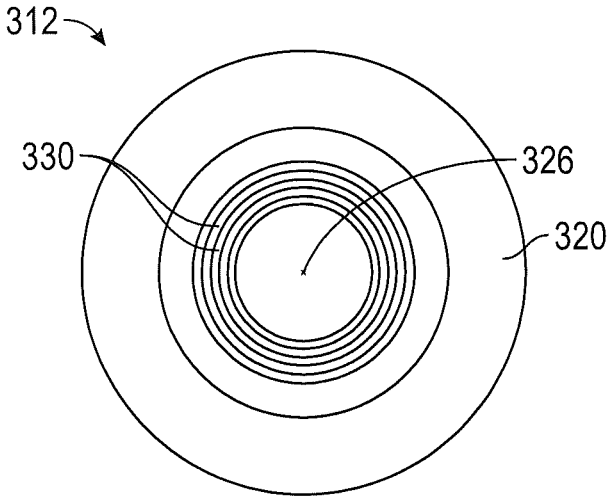
FIG. 3C shows a front elevation view of the nozzle of the cleaning tool of FIG. 2A for use in removing debris and particles.

FIGS. 3A-C show an exemplary nozzle suitable for use with exemplary cleaning tool 210. The nozzle 312 includes nozzle body 320, inlet 322, outlet 324, and stages 330.

Nozzle body 320 may be made of any suitable material, particularly any material that may withstand the environment of wellbore 102. An inlet 322 and outlet 324 are formed within the body 320 to allow flow therethrough. Inlet interface 328 may smooth the flow into inlet 324. Inlet interface 328 may have any suitable angle to smooth flow 114 and reduce turbulence of flow entering inlet 324. Inlet 324 directs flow 114 from bore 214 of tool 210 into the stages 330. After flow passes through stages 330, the flow 114 exits the nozzle 312 through outlet 324.

Inlet 322, outlet 324 and stages 330 are all concentrically formed with an axis 326. In an exemplary embodiment, nozzle 312 includes multiple stages 330. The stages 330 are in fluid communication with each other and are concentrically aligned along axis 326. Each stage 330 is generally cylindrically shaped with a length 332, a diameter 334, and an interface 336 between stages 330. Nozzle 312 may have at least three, four, or more successive concentric stages 330.

The length 332 and diameter 334 of each stage 330 may vary. In certain embodiments, the length 332 for each stage 330 may be the same or similar. In an exemplary embodiment, the diameter 334 of each successive stage 330 is smaller as the flow moves closer to the outlet 324, constricting in size to increase flow velocity as it passes through stages 330. The diameter 334 of each stage 330 is a discrete diameter, separate from a diameter 334 of another stage 330.

In between successive steps 330 an interface 336 is formed. Interface 336 is formed at the abutment of two successive stages 330 with different stage diameters 334. This interface 336 may also be referred to as a step. In an exemplary embodiment, the nozzle 312 may have at least two interfaces 336 located between the at least three stages 330. Interface 336 may have a slope or angle to assist the transition of flow 114 from a larger stage 330 to a smaller stage 330. In an exemplary embodiment, the interface angle is 15 degrees to 100 degrees. In certain embodiments, the angle is 45 degrees.

In an exemplary embodiment, a relationship or ratio is formed between the height of interface 336 and a respective stage length 332. In an exemplary embodiment, the ratio between the height of interface 336 and respective stage length 332 is between 3 to 1 and 20 to 1. In certain embodiments, the ratio is 10 to 1. Furthermore, in exemplary embodiments, the ratio between the height of interface 336 and respective stage length 334 may be the same for all stages.

Due to the characteristics of the stages 330, less energy loss and less turbulence is experienced compared to traditional nozzles. The use of at least 3 discrete steps or stages 330 and at least two interfaces 336 allows for less turbulence to propagate along the length of the nozzle 312 while increasing the velocity of the flow 114. In an exemplary embodiment, the nozzle 312 has a 99.5% efficiency, compared to traditional nozzles that may only have a 98.5% efficiency. As a result, the flow 114 to exit the nozzle 312 has less turbulence and internal circulation, allowing for higher velocity and longer travel, with minimal dispersion and velocity fall off. Accordingly, fluid friction of the flow 114 beyond the nozzle 312 is minimized and cleaning performance is increased.

Figure 3D:
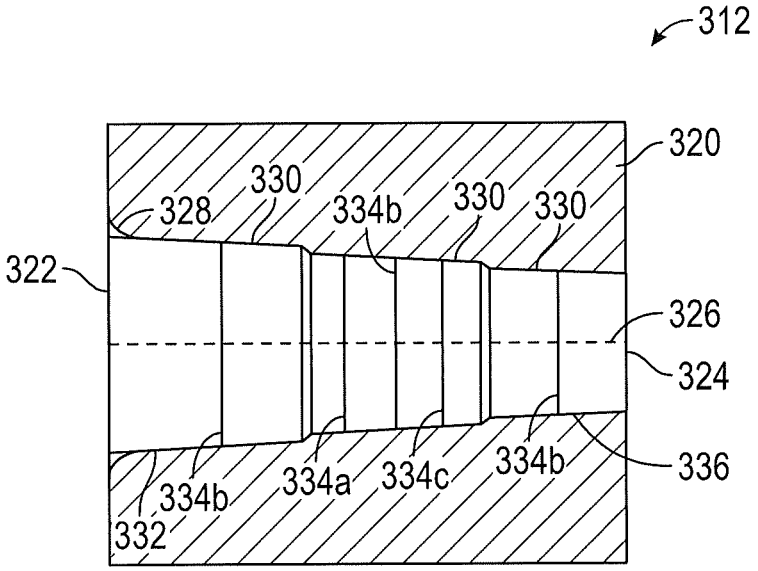
FIG. 3D shows a side elevation view of an alternative nozzle of the cleaning tool of FIG. 2A for use in removing debris and particles.

FIG. 3D shows an alternative embodiment of nozzle 312 wherein stages 330 have a varying diameter 334*a-c*. In certain embodiments, the varying diameter 334*a-c* may become continuously constricting along the flow path. In this embodiment, interfaces 336 are still formed between stages 330, as the diameters 334*a* and 334*c* of abutting stages are still different (dissimilar) diameters, causing a discrete "step" between stages 330.

Therefore in one aspect, the present disclosure provides a nozzle including an inlet; an outlet; at least four successive concentric stages in fluid communication with the inlet and the outlet, where the at least four stages each have a discrete length and a successively smaller discrete diameter; and a plurality of interfaces formed between each of the stages. In various embodiments, a ratio between at least one length of the at least four lengths and at least one height of at least one respective interface of the plurality of interfaces is at least 3 to 1. In certain embodiments, a ratio between at least one length of the at least four lengths and at least one height of at least one respective interface of the plurality of interfaces is not greater than 20 to 1. In various embodiments, at least one interface of the plurality of interfaces has an angle of at least 15 degrees. In various embodiments, at least one interface of the plurality of interfaces has an angle not greater than 100 degrees. In certain embodiments, each of the at least four lengths is the same. In certain embodiments, a height of each of the plurality of interfaces is the same. In certain embodiments, a ratio between each of the at least four lengths and a height of each of the plurality of interfaces is the same. In various embodiments, an angle of each of the plurality of interfaces is the same.

In another aspect, the present disclosure provides a system to clean a wellbore, including: a work string; and a jet sub containing at least one nozzle, wherein the at least one nozzle includes: an inlet; an outlet; at least four successive concentric stages in fluid communication with the inlet and the outlet, where the at least four stages each have a discrete length and a successively smaller discrete diameter; and a plurality of interfaces formed between each of the stages. In certain embodiments, a ratio between at least one length of the at least four lengths and at least one height of at least one respective interface of the plurality of interfaces is not greater than 20 to 1. In various embodiments, at least one interface of the plurality of interfaces has an angle of at least 15 degrees. In various embodiments, at least one interface of the plurality of interfaces has an angle not greater than 100 degrees. In certain embodiments, each of the at least four lengths is the same. In certain embodiments, a height of each of the plurality of interfaces is the same. In certain embodiments, a ratio between each of the at least four lengths and a height of each of the plurality of interfaces is the same. In various embodiments, an angle of each of the plurality of interfaces is the same.

In another aspect, the present disclosure provides a method for cleaning a wellbore, including: conveying a work string in a wellbore; providing a jet sub associated with the wellbore, wherein the jet sub includes at least one nozzle, the nozzle including: an inlet; an outlet; at least four successive concentric stages in fluid communication with the inlet and the outlet, where the at least four stages each have a discrete length and a successively smaller discrete diameter; and a plurality of interfaces formed between each of the stages; providing a completion fluid to the at least one nozzles via the work string and jet sub; and expelling the completion fluid via the at least one nozzles. In various embodiments, a ratio between at least one length of the at least four lengths and at least one height of at least one respective interface of the plurality of interfaces is at least 3 to 1. In certain embodiments, a ratio between at least one length of the at least four lengths and at least one height of at least one respective interface of the plurality of interfaces is not greater than 20 to 1. In various embodiments, at least one interface of the plurality of interfaces has an angle of at least 15 degrees. In various embodiments, at least one interface of the plurality of interfaces has an angle not greater than 100 degrees. In certain embodiments, a ratio between each of the at least four lengths and a height of each of the plurality of interfaces is the same. In certain embodiments, the expelled completion fluid allows for effective cleaning at a 20% further distance compared to conventional methods. In other certain embodiments, the expelled completion fluid allows for reduced fluidic drag compared to conventional methods.

While the foregoing disclosure is directed to the certain exemplary embodiments of the disclosure, various modifications will be apparent to those skilled in the art. It is intended that all variations within the scope and spirit of the appended claims be embraced by the foregoing disclosure.

What is claimed is:

1. A nozzle comprising:

a nozzle body mounted within a mounting ring of a cleaning sub;

an inlet for receiving fluid from a bore of the cleaning sub;

an outlet;

a flow path between the inlet and the outlet, the flow path including at least four successive concentric stages, where the at least four stages each have a discrete length and a diameter of each stage is continuously constricting along the flow path; and a discrete step formed at each abutment between successive stages.

2. The nozzle of claim 1, where a ratio between each length and a respective interface height is at least 3 to 1.

3. The nozzle of claim 1, where a ratio between each length and a respective interface height is less than 20 to 1.

4. The nozzle of claim 1, where each step has an angle with respect to an axis of at least 15 degrees.

5. The nozzle of claim 1, where the steps have an angle with respect to an axis less than 100 degrees.

6. The nozzle of claim 1, wherein each of the lengths is the same.

7. The nozzle of claim 1, wherein a respective height of each of the steps is the same.

8. The nozzle of claim 1, wherein a ratio between each of the lengths and a respective height of each of the steps is the same.

9. The nozzle of claim 1, wherein an angle of each of the steps is the same.

10. A system to clean a wellbore, comprising:

a work string; and a jet sub conveyed into the wellbore by the work string, the jet sub including a body with a bore therethrough and a mounting ring containing a at least one nozzle, wherein the at least one nozzle includes:

a nozzle body mounted within the mounting ring;

an inlet for receiving fluid from the bore of the jet sub;

an outlet;

a flow path between the inlet and the outlet, the flow path including at least four successive concentric stages, where the at least four stages each have a discrete length and a diameter of each stage is continuously constricting along the flow path; and a discrete step formed at each abutment between successive stages.

11. The system of claim 10, where a ratio between each length and a respective interface height is at least 3 to 1 and no greater than 20 to 1.

12. The system of claim 10, where the steps has an angle with respect to an axis of at least 15 degrees and less than 100 degrees.

13. The system of claim 10, where a ratio between each of the lengths and a respective height of each of the steps is the same.

14. The system of claim 10, wherein an angle of each of the steps is the same.

15. A method for cleaning a wellbore, comprising:

conveying a work string in a wellbore, the work string having a jet sub including a body with a bore therethrough and a mounting ring containing at least one nozzle, the nozzle including:

a nozzle body mounted within the mounting ring, an inlet for receiving fluid from the bore of the jet sub, an outlet, a flow path between the inlet and the outlet, the flow path including at least four successive concentric stages in fluid communication with the inlet and the outlet, where the at least four stages each have a discrete length and a diameter of each stage is continuously constricting along the flow path, and a plurality of interfaces formed between each of the stages a discrete step formed at each abutment between successive stages;

providing a completion fluid to the at least one nozzles via the work string and jet sub; and expelling the completion fluid via the at least one nozzles.

16. The method of claim 15, where a ratio between each length and a respective interface height are at least 3 to 1 and no greater than 20 to 1.

17. The method of claim 15, wherein each step has an angle with respect to an axis of at least 15 degrees and less than 100 degrees.

18. The method of claim 15, wherein a ratio between each of the lengths and a respective height of each of the steps is the same.

* * * * *